US006079906A

United States Patent [19]

Herrero Codina

[11] Patent Number: 6,079,906

[45] Date of Patent: Jun. 27, 2000

[54] METHOD FOR MAKING FOUNDATION PILING WITH DRILLING MACHINES

[76] Inventor: Juan Vicente Herrero Codina, Carretera C. 251, P.K. 5,5, 08440 Cardedeu, Spain

[21] Appl. No.: 09/052,445

[22] Filed: Mar. 31, 1998

[51] Int. Cl.[7] ..... E21B 7/26

[52] U.S. Cl. ..... 405/251; 405/241; 405/248; 405/249; 405/253; 175/21; 175/113; 175/162; 175/203

[58] Field of Search ..... 405/236, 241, 405/248, 249, 251, 253; 175/21, 23, 162, 203, 257, 394, 113, 122

[56] References Cited

U.S. PATENT DOCUMENTS

| | | | |
|---|---|---|---|
| 3,604,214 | 9/1971 | Turzillo | 405/241 |
| 4,504,173 | 3/1985 | Feklin | 405/240 |
| 4,595,059 | 6/1986 | Katagiri et al. | 166/290 |
| 5,002,435 | 3/1991 | Dupeuble | 405/241 |
| 5,927,905 | 7/1999 | Van Halteren | 405/241 X |

FOREIGN PATENT DOCUMENTS

| | | | |
|---|---|---|---|
| 0293584 | 12/1988 | European Pat. Off. | E02D 5/62 |
| 2566813 | 1/1986 | France | E02D 5/38 |

OTHER PUBLICATIONS

European Search Report (EP 97 50 0229) (3 pages).

*Primary Examiner*—Eileen Dunn Lillis
*Assistant Examiner*—Tara L. Mayo
*Attorney, Agent, or Firm*—Steinberg, Raskin & Liberchuk, P.C.

[57] ABSTRACT

A method for making foundation piles in soil with a drilling device having an auger, the auger including two concentric tubes, an outer tube occupying an upper part of the auger and an inner tuber projecting partially as a prolongation of the upper part and occupying a lower part of the auger, the inner tuber having a first screw and the outer having one of a second screw and a plurality of blades, both of said tubes being displaceable with respect to each other, the method including the steps rotating the inner tube in a first direction, simultaneously rotating the outer tube in an opposite direction of the first tube and advancing the auger through said soil whereby the soil is compacted against a wall of a formed hole by the combined action of the first screw and the one of the second screw and plurality of blades of the inner and outer tubes.

6 Claims, 3 Drawing Sheets

FIG. 4a
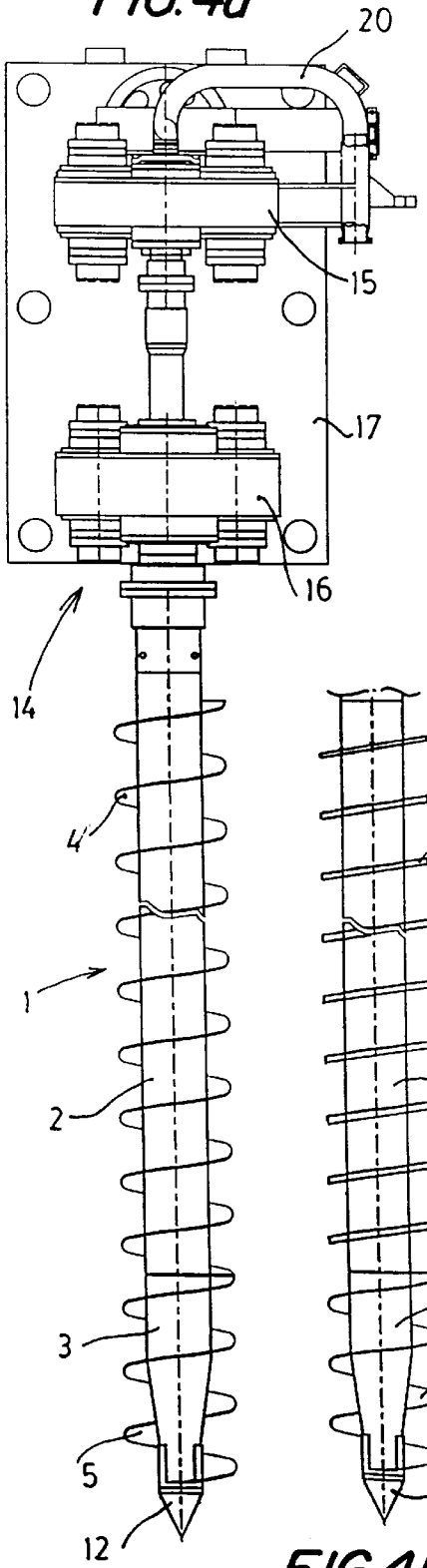
FIG. 5a
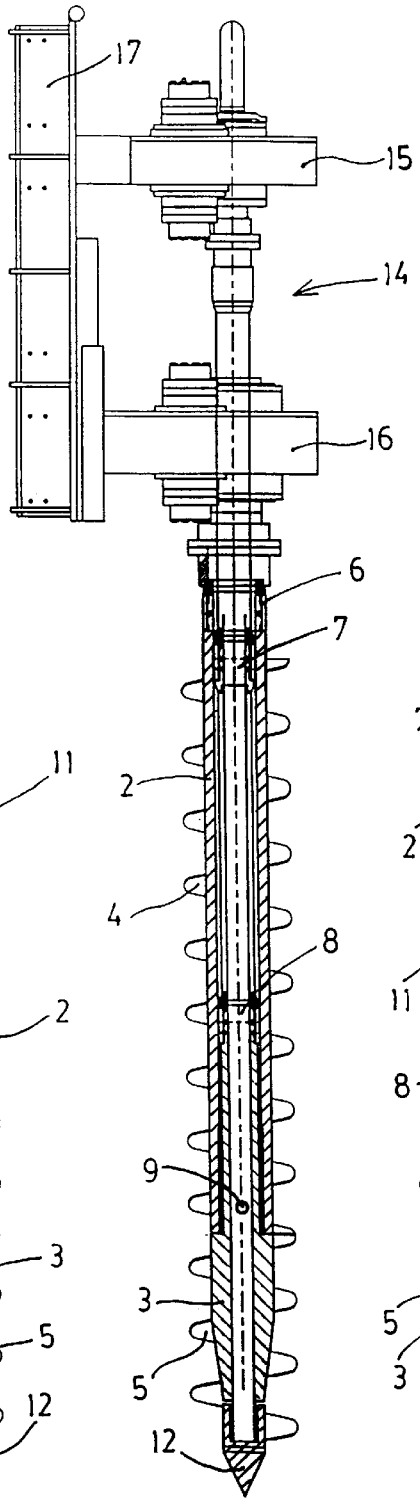
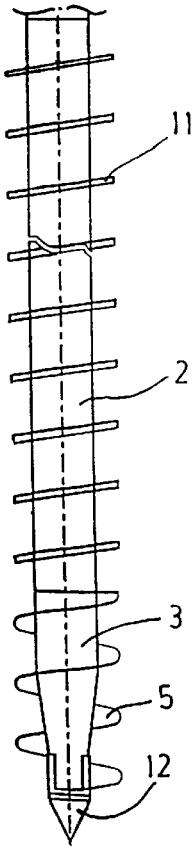
FIG. 4b
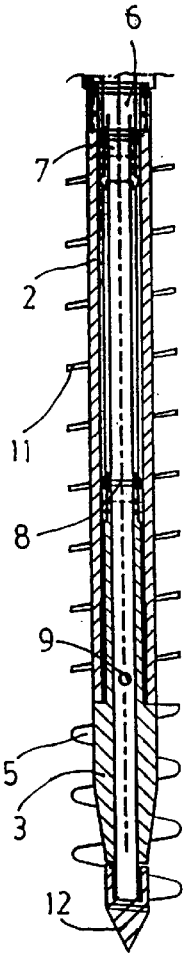
FIG. 5b

METHOD FOR MAKING FOUNDATION PILING WITH DRILLING MACHINES

The present invention relates to a method for making foundation piles with drilling machines of the type which include an auger, means for rotating said auger and means for longitudinal travel thereof.

BACKGROUND OF THE INVENTION

It is known that in order to make foundations for buildings it is necessary to make concrete piles, for which bore holes must be made in the ground.

In order to make said piles, known in the art are devices based on the utilization of continuous-screw augers provided with means for injecting the concrete into the hole. The drilling operation is thus combined with that of filling the hole with concrete up to the desired height.

The auger can be driven by a conventional drilling crane.

This type of foundation device is especially useful in sites with a certain degree of compaction. Where the ground is soft, however, the walls of the hole which it forms are not compact, and this can further lead to high consumption of concrete, because it penetrates deeper into the ground.

The conventional devices for drilling and compacting have the disadvantage that they require high driving power and, therefore, large and costly machines, since the shaft of the auger is practically of the same diameter as the pile to be made. Moreover, in the case of very soft soils, in order to improve their quality recourse is frequently had to strengthening the soil by injection of compacting products which are mixed with the soil, forming an emulsion-like paste, using devices which drive two or more augers in opposite directions.

Other technical solutions have also been provided to improve the quality of the hole, for example using a continuous-screw auger to combine the drilling operation with that of rendering the wall of the hole by injecting concrete against said wall, thereby providing it with a coating layer. A concrete jacket is thus achieved which provides the hole with suitable uniformity.

In this case also, there is the disadvantage of excessive consumption of concrete, so that for soft soils recourse is usually had to extracting the auger at higher speed, at the same time as the latter injects the concrete, thereby reducing the consumption. This operation can nevertheless lead to the wall of the hole having weak points at the strata of the ground where the soil is less compact.

The soil is sometimes drilled and then lined using formwork pipes which are sunk into the drilled bore hole. This lining operation can be carried out simultaneously with drilling, in such a way that the auger passes through the interior of the tube. However, this is a costly operation owing to utilization of such tubes, and it is also complicated due to extraction of the tube after the hole has been filled with concrete.

As can be seen, there exist a plurality of devices providing different solutions for making holes for foundation piles.

U.S. Pat. No. 3,604,214 discloses a method which comprises forming a bore by making two augers rotation in a synchronized fashion. Then the augers are raised out from the formed bore while fluid material is fed into the bore. For this operation, a smaller of the two augers is rammed downwardly to the lower end of the passage. The feeding of material is preformed by rotating the smaller auger within the larger of the two augers to thereby force the material into to the bore U.S. Pat. No. 4,504,173 discloses an apparatus and method of constructing tubular piles, the apparatus comprising two coaxially mounted tools for forming holes and the method comprises driving the apparatus into the soil to form the hole and then withdrawing it while simultaneously filing the hole with concrete material.

Finally, U.S. Pat. No. 4,595,059 discloses a method for providing a conductor pipe to an opening portion of a well. The method comprises forming a bore in the ground by means of a casing tube provided with an external round steel segment spirally welded about an outer surface of the casing tube and an inner auger screw. The tube and auger rotate in mutually opposite directions while advancing together (flush) into the ground. Subsequently, the inner auger is withdrawn leaving the outer tube in the ground as a casing.

DESCRIPTION OF THE INVENTION

The object of the present invention is to provide a new method for carrying out foundation piling, which permits combination of a plurality of functions in a single device, by using it according to the options described below.

The method of the invention comprises the steps of making the inner tube rotate in the opposite direction to the outer tube while the auger advances vertically through the ground, in order to compact the soil against the wall of the hole by the combined action of the screws or blades of the inner and outer tubes, said blades or screws of the two tubes having substantially the same outer diameter. The strength of the wall can thus be considerably increased and its permeability can be reduced. Also dynamic compaction of the soil is thus achieved.

For making a foundation pile, a machine is used which is adapted to perform the method of the present invention. This machine can also carry out multiple functions by means of the combined action of the rotation and the travel of the concentric tubes.

Said functions are those now described:

Continuous screw: this piling system is the one most commonly used at present, though it occasionally presents the disadvantage of excessive consumption of concrete due to the different strata of the soil not being homogeneous and presenting different consistencies.

This function is achieved by locking the outer tube onto the inner tube, so that both tubes rotate together in the same direction, making the auger rotate at the desired speed according to the characteristics of the site, the concrete being injected and deposited in the bore hole at the same time as the auger is removed.

Dynamic compaction: this function is achieved by making the inner tube rotate in the opposite direction to the outer tube, and normally at a different relative speed of rotation, while the auger advances vertically into the ground. The soil is thus compacted, considerably increasing the strength of the wall of the hole and reducing its permeability.

Emulsion: this function is achieved by longitudinal travel of the inner tube with respect to the outer tube. A region is thus left uncovered at which at least one orifice is provided through which concrete or any other supply material is injected. Thus, as the auger drills into the ground it renders the walls of the pile. This function also permits the soil to be strengthened by making suitable products flow through said orifice and mix with the soil.

This function requires the outer tube to be provided with blades.

Dynamic compaction and rendering of the wall of the pile: this function is achieved by making the inner tube rotate in a direction opposite to that of the outer tube, and normally at a different speed. Once the desired pile depth has been achieved, and during removal of the auger, concrete is injected through the orifice existing between the inner tube and the outer tube. The previously compacted wall is thus rendered.

A fifth function is thus achieved which consists in making the material emerge from the interior of the tube towards the soil, once the penetrating and centring head has been displaced.

The dynamic compaction method can also be combined with the rendering process.

As can be seen, the invention provides a new system which includes a device and method with the multiple functions which have been described.

BRIEF DESCRIPTION OF THE DRAWINGS

For a better understanding of all that has been set out herein, the present specification is accompanied by some drawings which, schematically and solely by way of non-restrictive example, show several preferred embodiments of the device for performing the method of the present invention.

In said drawings,

FIG. 4*a* is a front view of the rotation tables,

FIG. 4*b* is a detail view of an auger of the type which comprises an inner tube provided with a screw and an upper tube provided with a number of blades;

FIG. 5*a* is a section view corresponding to the side elevation of FIG. 4*a*;

FIG. 5*b* is a section view corresponding to the side elevation of FIG. 4*b*.

DESCRIPTION OF PREFERRED EMBODIMENTS

Figure 1:
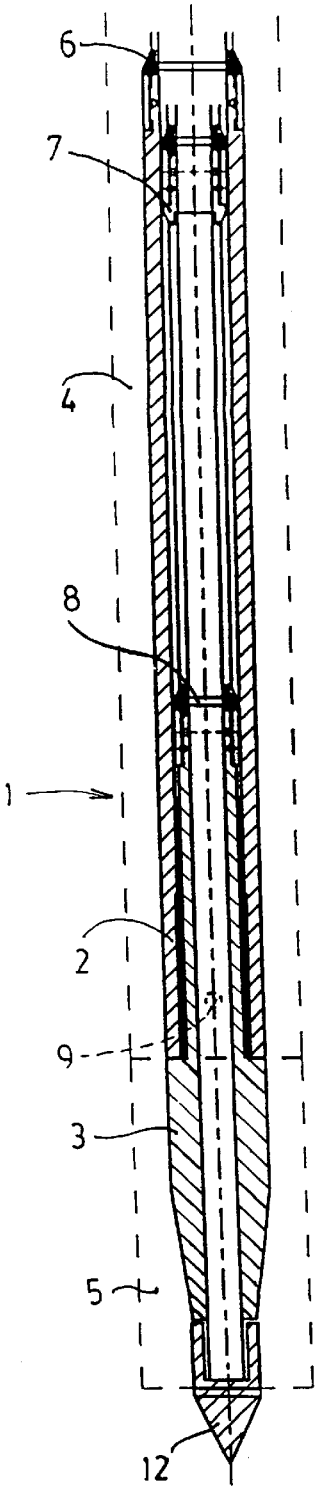
FIG. 1 is a section view of the auger when operating as a continuous screw with the outer tube attached to the inner tube so that both rotate at the same time.

FIG. 1 shows an auger 1 which comprises two concentric tubes 2,3, the outer tube 2 occupying the upper part of the auger and the inner tube 3 projecting partially as a prolongation of the aforesaid upper part and occupying the lower part of the auger. The outer tube 2 is provided with a screw 4 and the inner tube 3 is provided with a screw 5 (the outer outline of both screws has been shown as a broken line), the tubes 2,3 being coupled together so that they can rotate at the same time and permit operation as a continuous screw, as described above. The upper part of the auger 1 has means 6 for coupling said auger to the rotation tables. The inner tube 3 has means 7,8 for longitudinal travel thereof with respect to the outer tube 2.

Figure 2:
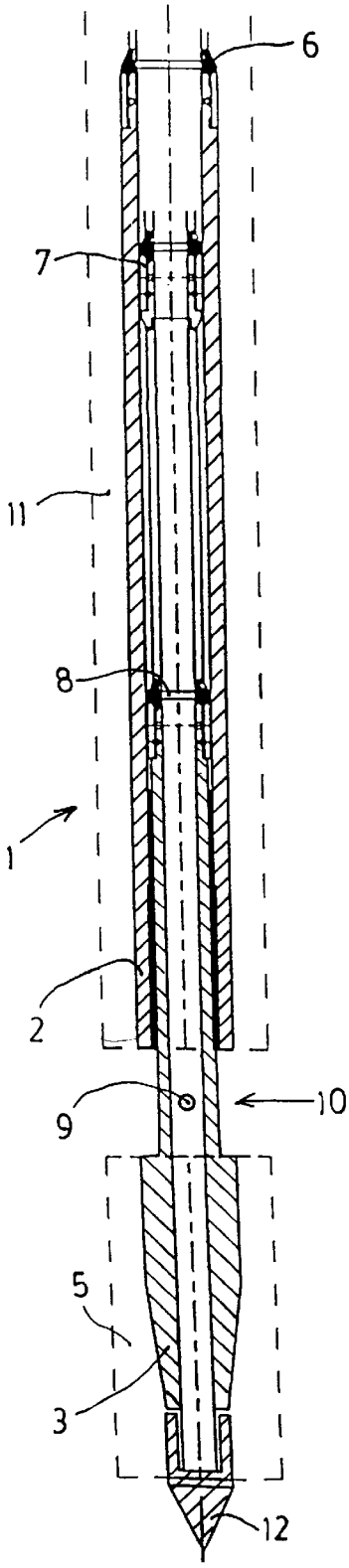
FIG. 2 is a section view of the auger similar to that of FIG. 1, but showing the inner tube when it has been displaced with respect to the outer tube in order to carry out the emulsion operation.

As shown in FIG. 2, the inner tube 3 has an orifice 9 at the region 10 which is left uncovered when the inner tube 3 has been displaced with respect to the outer tube 2. In this position, the device of the invention permits carrying out the operation of emulsion and rendering of the wall of the pile as described above. For this purpose, the outer tube 2 has to be provided with blades 11 (illustrated in the figure by a broken line) and the inner tube 3 with screws 4 (also shown by broken lines).

The lower end of the auger 1 has a penetrating and centring head 12 fitted concentrically on the lower end of the inner tube 3 and displaceable with respect to it.

Figure 3:
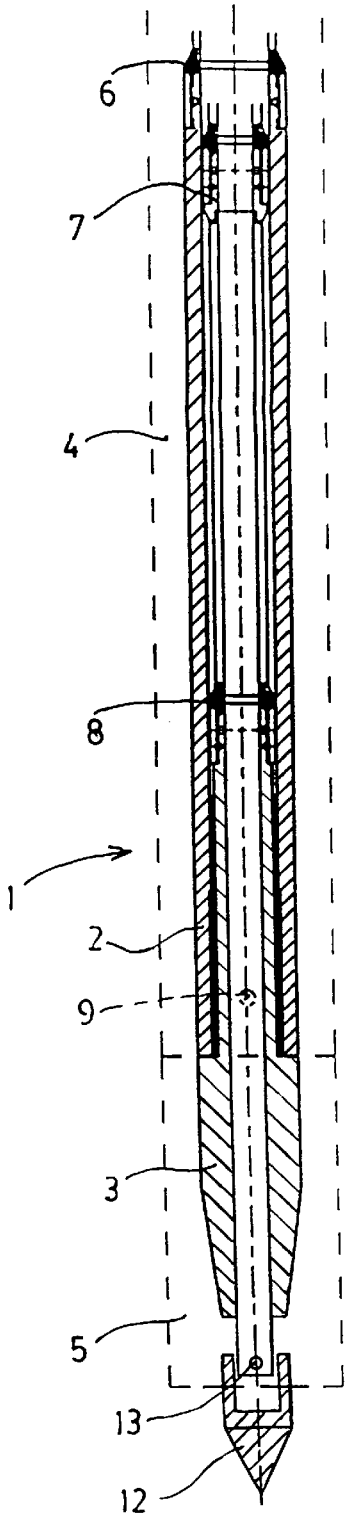
FIG. 3 is also a section view of the auger similar to that of the previous figures, but with the centring head displaced with respect to the inner tube.

When the head 12 has travelled with respect to the inner tube 3, an opening 13 is left uncovered through which there emerges the supply material from the interior of said inner tube 3, as shown in FIG. 3.

As shown in FIG. 4, the means of rotation and travel 14 include two rotation tables 15,16 provided with two reduction-gear motors which operate independently for each one of the tubes 2,3 of the auger 1.

Figure 8:
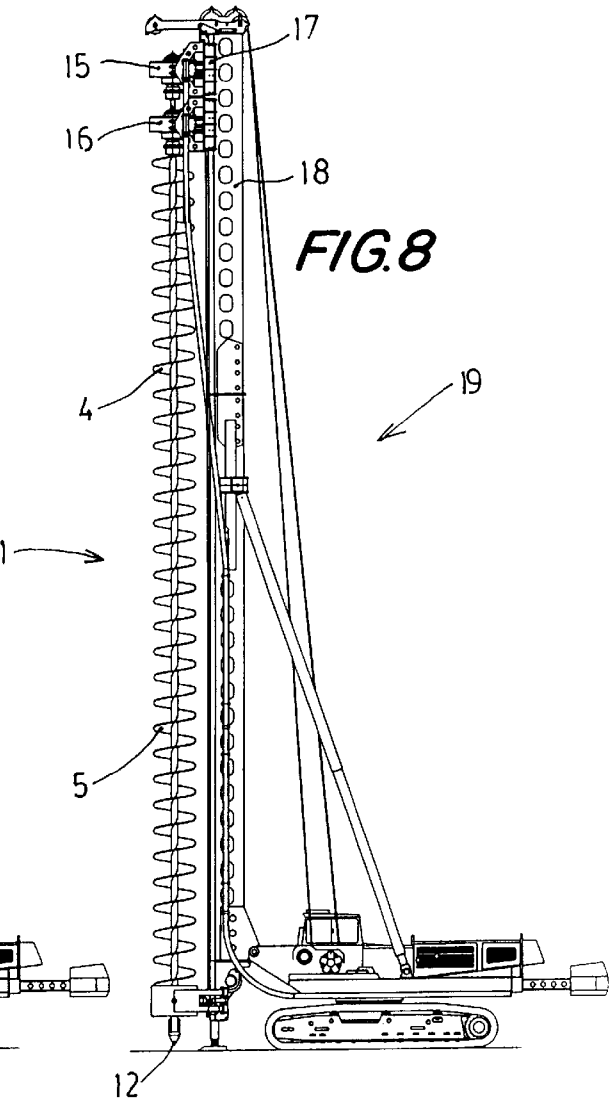
FIG. 8 is also a front view of the drilling crane, but showing the auger provided with a screw.
Figure 7:
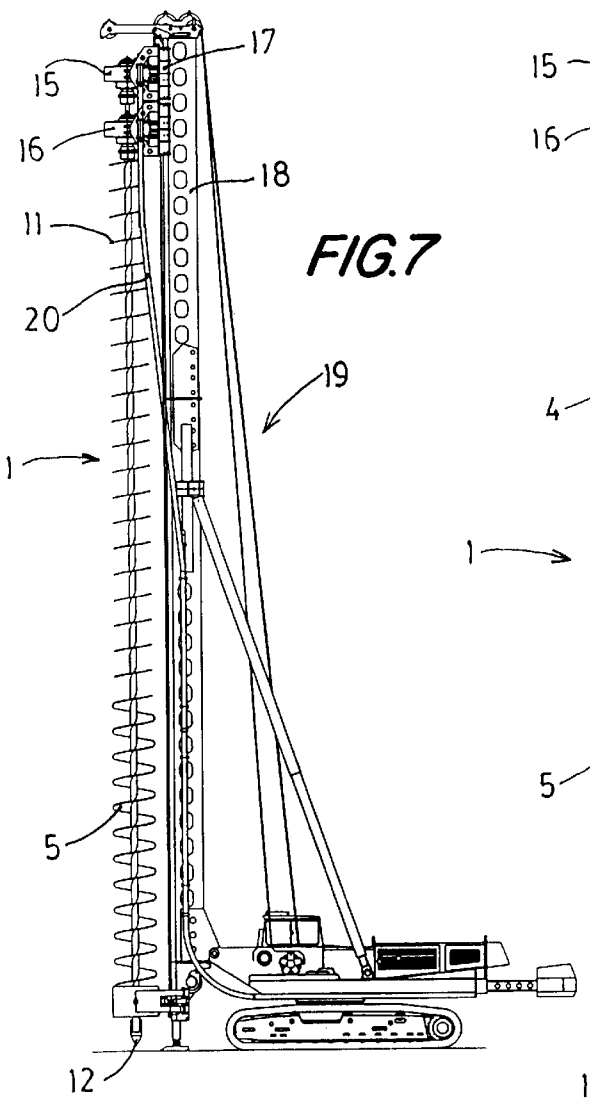
FIG. 7 is a side view corresponding to FIG. 6, showing the auger whose inner tube is provided with a screw and whose outer tube is provided with a plurality of blades.
Figure 6:
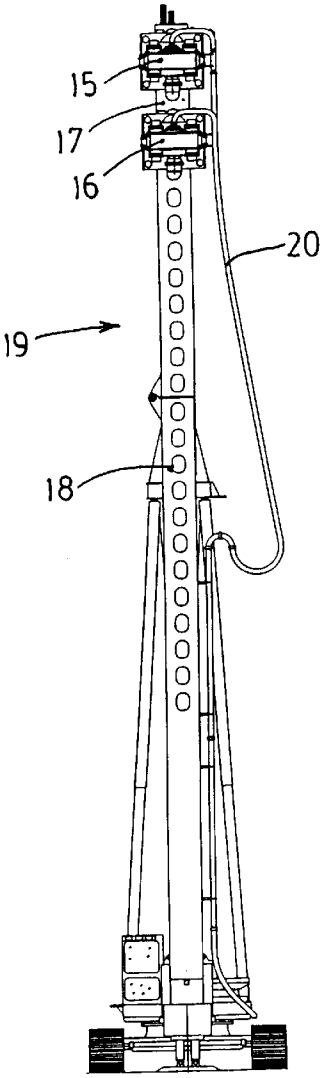
FIG. 6 is a front view of the drilling crane showing the two rotation tables.

As shown in FIG. 5, the means of rotation and travel 14 are suitably attached to a sliding element 17. Said element travels along the tower 18 of the drilling crane 19 (shown in FIGS. 6,7 and 8) and allows the vertical movement of the auger. This sliding element can be driven by the drilling crane 19 through drive means 20 coupled onto the respective rotation tables 15,16.

Using the device of the invention, drilling of the ground is carried out by coupling the lower screw 5 to the blade mechanism 11, so that both turn at the same time.

Dynamic compaction of the soil is carried out by making the inner tube 3 rotate in the opposite direction to the outer tube 2 at different relative speeds of rotation, while the auger 1 advances vertically though the ground.

A third method for foundation piling with drilling machines using the device of the invention consists in displacing the inner tube 3 with respect to the outer tube 2 to uncover a region 10 in which there is at least one orifice 9 through which concrete or any other compacting material is injected for rendering the walls of the pile, as the auger drills into the ground, or for strengthening the ground by causing suitable products to flow through said orifice.

Another method consists in making the material emerge through the interior of the tube 3 though the orifice 13 and towards the soil, once the penetrating and centring head 12 has been displaced with respect to said inner tube 3.

What is claimed is:

1. A method for making foundation piles in soil with a drilling device comprising an auger, means for rotating said auger and means for controlling the longitudinal travel thereof; said auger including two concentric tubes, an outer tube occupying an upper part of the auger and an inner tube projecting partially as a prolongation of the upper part and occupying a lower part of the auger, the inner tube having a first screw and the outer tube having one of a second screw and a plurality of blades, both of said tubes being displaceable with respect to each other, and said means for rotating and said means for controlling longitudinal travel being independent for each one of the tubes, said, method comprising the steps:

rotating the inner tube in a first direction;

simultaneously rotating the outer tube in an opposite direction of the first tube and advancing the auger through said soil whereby the soil is compacted against a wall of a formed hole by the combined action of the first screw and the one of the second screw and plurality of blades of the inner and outer tubes.

2. The method of claim 1, wherein said first screw and said one of said second screw and plurality of blades have substantially the same outer diameter.

3. The method of claim 1, wherein the a speed of rotation of said inner tube and speed of rotation of said outer tube are not equal.

4. The method of claim 1, further comprising displacing the inner tube with respect to the outer tube to uncover a region in which there is at least one orifice through which a compacting material is injected for rendering the walls of the pile.

5. The method of claim 1, further comprising:

separating from the inner tube a penetrating and centering head which is coupled to said inner tube and can be displaced with respect to said inner tube;

making a compacting material emerge through the interior of said inner tube towards said soil through an opening in said penetrating and centering head.

6. The method of claim 1, further comprising removing said auger from said formed hole; and after removing said auger introducing a compacting material into said formed hole.

* * * * *